US008886096B2

(12) United States Patent
Matsushita et al.

(10) Patent No.: US 8,886,096 B2
(45) Date of Patent: Nov. 11, 2014

(54) BELT-SHAPED MEMBER FOR IMAGE FORMING APPARATUS AND IMAGE FORMING APPARATUS

(75) Inventors: Makoto Matsushita, Osaka (JP); Akira Izutani, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 52 days.

(21) Appl. No.: 13/438,082

(22) Filed: Apr. 3, 2012

(65) Prior Publication Data

US 2012/0294657 A1 Nov. 22, 2012

(30) Foreign Application Priority Data

May 20, 2011 (JP) ..... 2011-113254

(51) Int. Cl.
*G03G 15/01* (2006.01)

(52) U.S. Cl.
USPC ..... 399/302

(58) Field of Classification Search
USPC ..... 399/162, 302, 308, 313, 329; 198/844.1; 428/422.8, 424.4, 424.6, 428/424.8
See application file for complete search history.

(56) References Cited

U.S. PATENT DOCUMENTS

| | | | | |
|---|---|---|---|---|
| 5,995,794 | A * | 11/1999 | Osada et al. | 399/302 |
| 6,376,033 | B1 * | 4/2002 | Sonobe et al. | 428/34.7 |
| 7,604,112 | B1 * | 10/2009 | Lee | 198/831 |
| 7,903,987 | B2 | 3/2011 | Matsushita et al. | |
| 7,925,187 | B2 | 4/2011 | Izutani et al. | |
| 8,041,243 | B2 | 10/2011 | Matsushita et al. | |
| 8,059,981 | B2 | 11/2011 | Yamashita et al. | |
| 8,090,303 | B2 | 1/2012 | Hayashi et al. | |
| 2009/0014289 | A1 * | 1/2009 | Walter | 198/847 |
| 2009/0060540 | A1 | 3/2009 | Matsushita et al. | |
| 2009/0190949 | A1 | 7/2009 | Hamahashi et al. | |
| 2011/0008069 | A1 | 1/2011 | Matsushita et al. | |
| 2011/0217653 | A1 | 9/2011 | Izutani et al. | |
| 2011/0249994 | A1 | 10/2011 | Matsushita et al. | |

FOREIGN PATENT DOCUMENTS

| | | | | |
|---|---|---|---|---|
| JP | 08063000 | A | * | 3/1996 |
| JP | 2000-264477 | | | 9/2000 |
| JP | 2001117396 | A | * | 4/2001 |
| JP | 2002251078 | A | * | 9/2002 |
| JP | 2002278365 | A | * | 9/2002 |
| JP | 2003012949 | A | * | 1/2003 |
| JP | 2004177600 | A | * | 6/2004 |
| JP | 2005-62822 | | | 3/2005 |
| JP | 2005257795 | A | * | 9/2005 |
| JP | 2005-316028 | | | 11/2005 |
| JP | 2006-150896 | | | 6/2006 |
| JP | 2007065587 | A | * | 3/2007 |
| JP | 2008116700 | A | * | 5/2008 |
| JP | 2011-186035 | | | 9/2011 |

* cited by examiner

*Primary Examiner* — Robert Beatty
(74) *Attorney, Agent, or Firm* — Oblon, Spivak, McClelland, Maier & Neustadt, L.L.P.

(57) ABSTRACT

A belt-shaped member for image forming apparatus, satisfying the following relationships:

$E1 \geq E2$; and $H2 > H1$ wherein E1 represents an elastic modulus of a center of the belt-shaped member in a thrust direction; E2 represents an elastic modulus of an end thereof; H1 is a breaking elongation of the center; and H2 represents a breaking elongation of the end.

13 Claims, 2 Drawing Sheets

BELT-SHAPED MEMBER FOR IMAGE FORMING APPARATUS AND IMAGE FORMING APPARATUS

CROSS-REFERENCE TO RELATED APPLICATIONS

This patent application is based on and claims priority pursuant to 35 U.S.C. §119 to Japanese Patent Application No. 2011-113254, filed on May 20, 2011, in the Japanese Patent Office, the entire disclosure of which is hereby incorporated herein by reference.

FIELD OF THE INVENTION

The present invention relates to a belt-shaped member for use in electrophotographic image forming apparatus, such as image developer, photoreceptor, charger, transferer, cleaner and fixer.

BACKGROUND OF THE INVENTION

As a transfer belt for use in electrophotographic image forming apparatus, materials having durability and high strength such as polyimide and polyamideimide are known.

However, such thermoplastic resin belts have poor strength. A transfer belt formed of polyimide has creep and elongation resistance, but has a fragile end needing a reinforcing tape, resulting in problems of productivity and cost.

Japanese published unexamined application No. 2006-150896 and Japanese Patent No. 3821600 disclose a method of irradiating an electron beam to a resin endless belt after melted, extruded and molded for the purpose of increasing strength thereof.

This is common with the present invention in irradiating an electron beam.

However, this method continuously extrudes a belt without distinguishing an end from the other parts and irradiates an electron beam to the whole surface of the belt, resulting in the fragile end of the belt having improved elasticity.

Japanese Patent No. 3821600 discloses a method of applying a reinforcing tape along an edge of an outer surface of the belt. Japanese published unexamined application No. 2005-62822 discloses a transfer belt including a polymer alloy binder formed of an anti-crack polyester polyether elastomer for improving toner adherence in the first transfer and polybutyleneterephthalate more flexible than PET resins for ensuring toner transferability in the second transfer, and an electroconductive material dispersed therein. However, it is recommended that an end reinforcing tape is used, and which does not mean the belt end has sufficient strength.

Because of these reasons, a need exist for a belt-shaped member having an unbreakable end.

SUMMARY OF THE INVENTION

Accordingly, one object of the present invention to provide a belt-shaped member having an unbreakable end, which is strengthened by crosslinking polyvinylidene fluoride which is a productive thermoplastic resin less expensive than polyimide by irradiation of an electron beam, and the end is not or slightly crosslinked.

Another object of the present invention to provide an image forming apparatus using the belt-shaped member.

These objects and other objects of the present invention, either individually or collectively, have been satisfied by the discovery of a belt-shaped member for image forming apparatus, satisfying the following relationships:

$$E1 \geq E2; \text{ and}$$

$$H2 > H1$$

wherein E1 represents an elastic modulus of a center of the belt-shaped member in a thrust direction, that is, in a width direction perpendicular to a direction of travel of the belt-shaped member; E2 represents an elastic modulus of an end thereof; H1 is a breaking elongation of the center; and H2 represents a breaking elongation of the end.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

The present invention provides a belt-shaped member having an unbreakable end, which is strengthened by crosslinking polyvinylidene fluoride which is a productive thermoplastic resin less expensive than polyimide by irradiation of an electron beam, and the end is not or slightly crosslinked.

More particularly, the present invention relates to a belt-shaped member for image forming apparatus, satisfying the following relationships:

$$E1 \geq E2; \text{ and}$$

$$H2 > H1$$

wherein E1 represents an elastic modulus of a center of the belt-shaped member in a thrust direction; E2 represents an elastic modulus of an end thereof; H1 is a breaking elongation of the center; and H2 represents a breaking elongation of the end.

Figure 2:
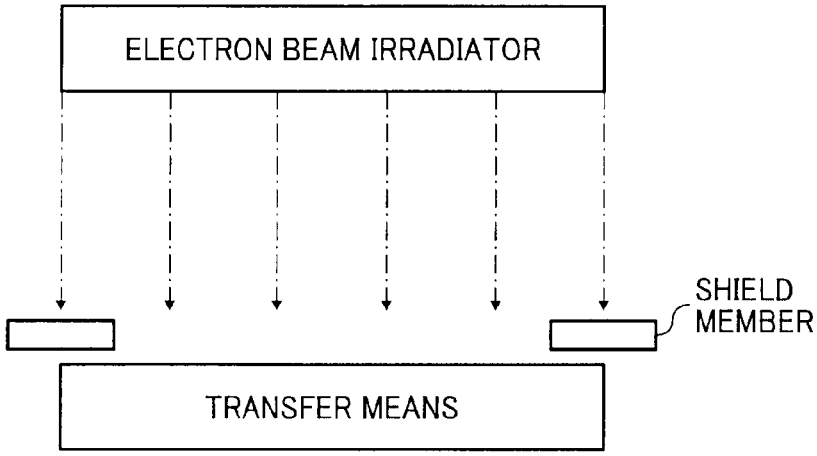
FIG. 2 is a schematic view illustrating an embodiment of electron beam irradiator for use in the present invention.

In the present invention, in order to simply and precisely prepare the above-mentioned a belt-shaped member, a center thereof is coated to be crosslinked and an end thereof is not coated or less coated than the center, and they are irradiated with an UV ray or an electron beam to be crosslinked such that the center has higher crosslink density than the end, but the method is not limited to this. In consideration of yield rate, handling and cost, a wet process is better than a dry process, and a single layer is more productive than a multilayer. For example, a belt member formed of electron-beam crosslinkable resins such as PVDF and PE, optionally a crosslinker such as isocyanurate may be dispersed in the resin. As FIG. 2 shows, a material such as lead blocking an electron beam is used at the end, an electron beam is irradiated to the belt-shaped member while rotated without uneven irradiation in a rotational direction. When the center of the belt-shaped member has a width not less than 50% of a length of the thrust, the belt-shaped member improves in strength, and an image forming apparatus using the belt-shaped member as a transfer belt produces improved quality images. Many an electrophotographic image forming apparatus includes a belt-shaped member as a cleaning member pressing a blade formed of urethane rubber to scrape a toner. When an electron beam is irradiated to the blade wider than a width thereof, poor cleaning such as a toner or an external additive scraping through the blade and filming with a paper powder can be prevented. When the electron beam has an acceleration voltage less than 40 kV, the resin is not fully crosslinked. When the electron beam has an absorbed dose greater than 1,000 kGy, the resin breaks too much, resulting in a crack.

[Electron Beam Crosslinker]

The crosslinkers are not particularly limited, if they can perform crosslinking reactions when irradiated with an electron beam. Acrylic multifunctional monomers are preferably used. Specific examples of the acrylic multifunctional monomers include triallylisocyanurate, triallylcyanurate, trimethallylisocyanurate, diallylmonoglycidylisocyanurate (DA-MGIC), etc. Among these, DA-MGIC is most preferably used because of exerting a crosslinking effect in a small amount.

Specific examples of the other crosslinkers include multifunctional (meth)acrylic monomers such as diethyleneglycoldi(meth)acrylate, dipentaerythritolhexa(meth)acrylate, dipentaerythritolmonohydroxypenta(meth)acrylate, pentaerthritoltri(meth)acrylate, pentaerthritoltetra(meth)acrylate, polyethyleneglycoldi(meth)acrylate, trimethylolpropanetri(meth)acrylate, tris(acryloxyethyl)isocyanurate, tris(methacryloxyethyl)isocyanurate and their mixtures. These can be used alone or in combination. The crosslinker is preferably included in an amount of from 0.5 to 15 parts by weight, and more preferably from 2 to 10 parts by weight per 100 parts by weight of the resin. When the amount is too much, the resultant belt has poor appearance and low strength.

[Antioxidant]

Hindered phenol antioxidants such as 2,6-di-t-butyl-4-methylphenol, 1,6-hexanediol-bis[3-(3,5-di-t-butyl-4-hydroxyphenyl)propionate], pentaerythrityl-tetrakis[3-(3,5-di-t-butyl-4-hydroxyphenyl)propionate], 2-t-butyl-6-(3'-t-butyl-5'methyl-2'-hydroxybenzyl)-4-methylphenylacrylate, (2,2-thio-diethylenebis[3-(3,5-di-t-butyl-4-hydroxyphenyl) propionate], dibutylhydroxytoluene, octadecyl-3-(3,5-di-t-butyl-4-hydroxyphenyl)propionate and/or phosphorous antioxidants such as tetrakis-(2,4-di-t-butylphenyl)4,4-biphenylenediphosphonite, tris(2,4-di-ti-butyl)phenylphosphite, tris(2,4-di-ti-butylphenyl)phosphate are preferably included in the resin.

The phenol antioxidants can be used alone or with the phosphorous antioxidants, and the content thereof is preferably from 0.02 to 0.5% by weight (200 to 5,000 ppm).

[Image Forming Apparatus]

In the present OA apparatuses such as electrophotographic image forming apparatuses, electrostatic printing apparatuses, inkjet printing apparatuses and thermal recording apparatuses, image recording media such as papers and plastic sheets are transferred and various belt-shaped members feeding toners or inks on the image recording media directly or through an intermediate transferers are used. Hereinafter, an endless intermediate transfer belt is explained as a typical example.

Figure 1:
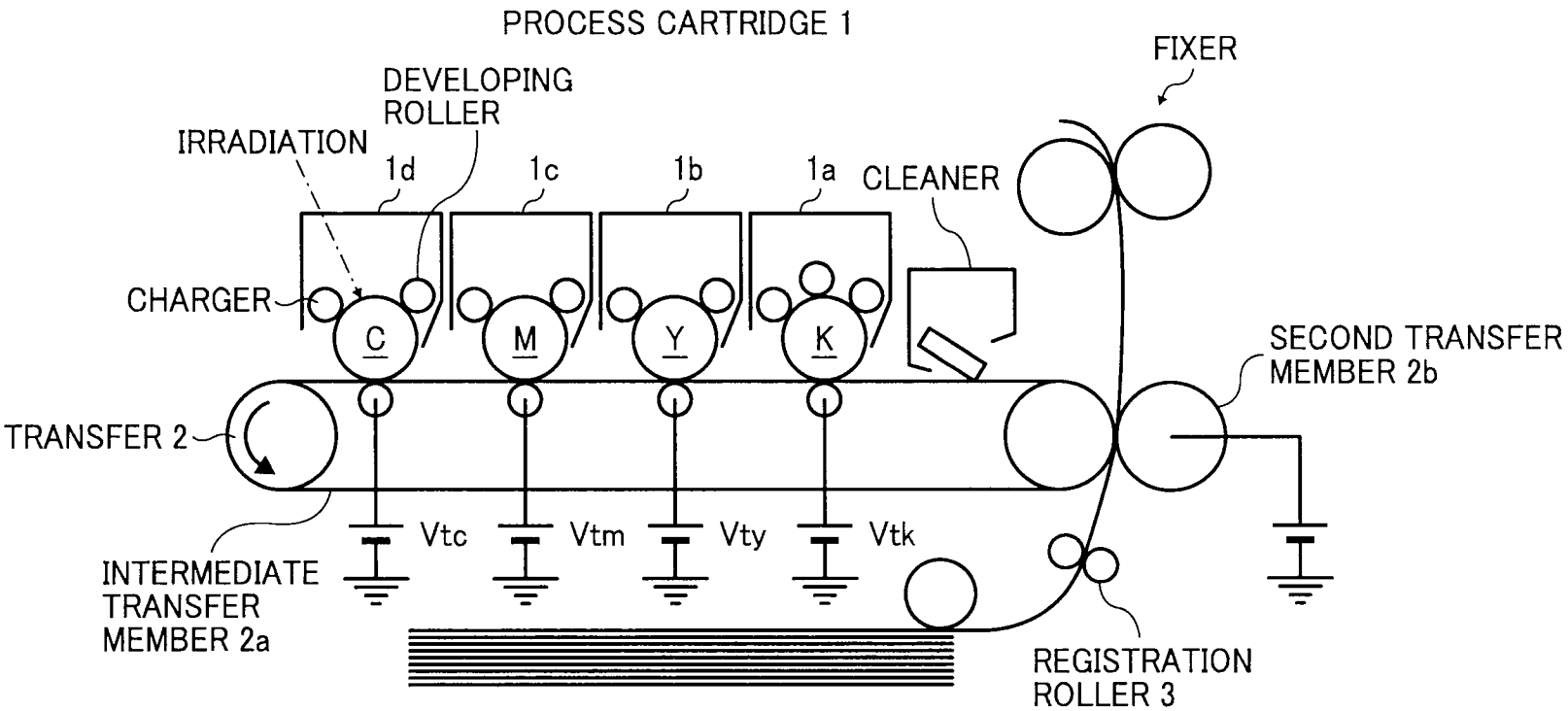
FIG. 1 is a schematic view illustrating a full-color laser printer as an embodiment of the image forming apparatus of the present invention.

FIG. 1 is a schematic view illustrating a full-color laser printer as an embodiment of the image forming apparatus of the present invention.

In a process cartridge (1), each of photoreceptors is charged by each of charging rollers and irradiated to form each color (black(K), yellow(Y), magenta(M) and cyan(C)) of electrostatic latent images thereon, and each color (black (K), yellow(Y), magenta(M) and cyan(C)) of toners in a each of cartridges is charged by each of developing rollers and transferred to each of developing points where each of the electrostatic latent images is developed to form each of toner images.

Each of the toner images is first transferred by an electric field onto a transfer belt applied with a bias, and layered to form a full-color toner image which is secondly transferred by an electric field onto a transfer material. Then, the full-color toner image is melted with heat by a fixer and fixed on the transfer material.

The toner remaining on the transfer material untransferred at the second transfer point is collected by a cleaner. A low-cost simply-structured blade cleaner is often used.

FIG. 2 is a schematic view illustrating an embodiment of electron beam irradiator for use in the present invention.

The electron beam irradiator is from NHV Corp.

A shield member is used to protect a part not to be irradiated with an electron beam. Metals such as lead, iron and stainless can be used as the shield member.

Figure 3:
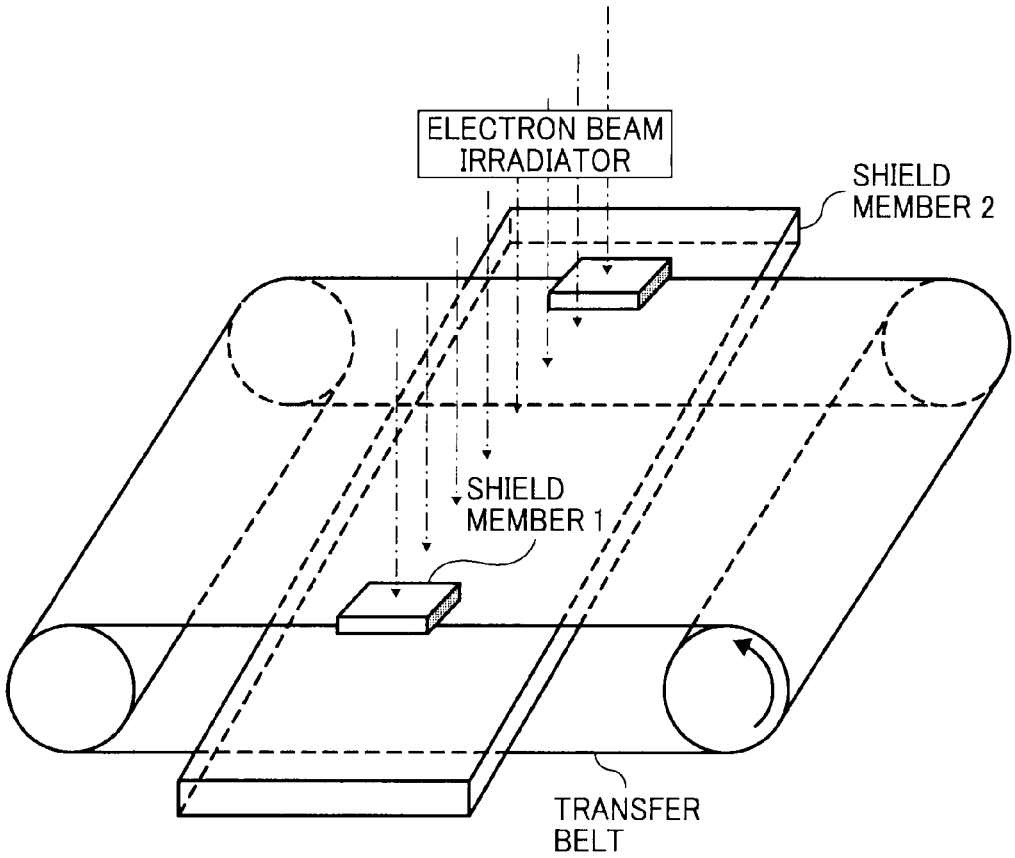
FIG. 3 is a schematic view illustrating another embodiment of electron beam irradiator for use in the present invention.

As FIG. 3 shows, a rotational body may be irradiated with an electron beam and a shield member (2) shields the electron beam having penetrated through the body so as to less influence upon a back side thereof.

EXAMPLES

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

Example 1

Each end of a seamless belt formed of polyvinylidene fluoride (PVDF) was shielded with a shield member (SUS having a thickness of 10 mm) as FIG. 2 shows. The belt was irradiated with an electron beam of 80 kGy at an acceleration voltage of 150 kV in a nitrogen atmosphere while rotated at 10 m/min. The belt was rotated for 4 times to be irradiated with an electron beam of 320 kGy totally.

The seamless belt had a width of 230 mm, a circumferential length of 650 mm, a thickness of 100 μm and a surface resistivity of $1\times10^{10}$ when applied with 500 v at 23° C. 60% RH.

The elasticity was measured according to JIS-K7127.

Comparative Example 1

An intermediate transfer belt irradiated with an electron beam without a shield member was prepared.

The intermediate transfer belt was installed in IPSIO C310 from Ricoh Company, Ltd., and 90,000 images having a printed ratio of 5% at 23° C. 60% RH.

The results are shown in Table 1.

The belt in Comparative Example 1 had a crack at the end and could not produce 90,000 images.

TABLE 1

| | Material | Elasticity Center E1 | Elasticity End E2 | Tensile breaking Elongation Center H1 | Tensile breaking Elongation End H2 | Durability (End crack) | Elongation |
|---|---|---|---|---|---|---|---|
| Example 1 | PVDF | 1700 | 930 | 3% | 18% | Good | Good |
| Comparative Example 1 | PVDF | 1700 | 1700 | 3% | 3% | Poor | Good |

Example 2

The procedure for preparation of the belt in Example 1 was repeated except that the shield member had a length of 57.5 mm from the end of the belt.

Example 3

The procedure for preparation of the belt in Example 1 was repeated except that the shield member had a length of 11.5 mm from the end of the belt.

Comparative Example 2

The procedure for preparation of the belt in Example 1 was repeated except that the shield member had a length of 69 mm from the end of the belt.

Examples 2 and 3 had no problems, but Comparative Example 2 had a low-elasticity part of 60%. When more than 50%, elongation or creep occurred, resulting in color shift.

The color shifts was evaluated by measuring a color shift amount with a ladder pattern chart.

A color shift greater than 300 μm in K, Y, M and C colors was poor, and a color shift not greater than 300 μm was good.

The results are shown in Table 2.

TABLE 2

| | Elasticity Center E1 | Elasticity End E2 | Tensile breaking Elongation Center H1 | Tensile breaking Elongation End H2 | Center width | Durability (End crack) | Elongation creep |
|---|---|---|---|---|---|---|---|
| Example 2 | 1700 | 930 | 3% | 18% | 50% | Good | Good |
| Example 3 | 1700 | 930 | 3% | 18% | 90% | Good | Good |
| Comparative Example 2 | 1700 | 930 | 3% | 18% | 40% | Good | Poor |

Example 4

The shield member had a length of 9.2 mm from the end of the belt and 211.6 mm same as an image area width was an electron beam irradiated part.

Each end of a seamless belt formed of polyvinylidene fluoride (PVDF) was shielded with the shield member (SUS having a thickness of 10 mm) as FIG. 2 shows. The belt was irradiated with an electron beam of 80 kGy at an acceleration voltage of 150 kV in a nitrogen atmosphere while rotated at 10 m/min. The belt was rotated for 4 times to be irradiated with an electron beam of 320 kGy totally.

The belt was installed in IPSIO C310 from Ricoh Company, Ltd. as an intermediate transfer belt, and 90,000 images having a printed ratio of 5% at 23° C. 60% RH.

Comparative Example 3

The procedure for preparation and evaluation of the belt in Example 4 was repeated except that the shield member had a length such that the central irradiated area was 75% (172.5 mm).

The intermediate transfer belt is extended by plural rollers with tension and four photoreceptors for each color are located, and therefore when the same image patterns are continuously produced, the belt surface is pressed by each of the rollers and plastically deformed to have concavities and convexities, resulting in production of poor halftone images.

Particularly, this is noticeable after formatted documents are continuously printed.

When the electron beam irradiated part was extended to the image area, large concavities and convexities were not formed on the resultant belt surface as in Example 4 and quality images were produced.

The results are shown in Table 3.

TABLE 3

| | Elasticity Center E1 | Elasticity End E2 | Tensile breaking Elongation Center H1 | Tensile breaking Elongation End H2 | Durability Center width | Durability (End crack) | Durability Elongation creep | Durability Image quality |
|---|---|---|---|---|---|---|---|---|
| Example 4 | 1700 | 930 | 3% | 18% | 92% (211.6 mm) | Good | Good | Good |
| Comparative Example 3 | 1700 | 930 | 3% | 18% | 75% (172.5 mm) | Good | Good | Poor |

Example 5

The shield member had a length of 4 mm from the end of the belt and 223.1 mm same as a cleaning part was an electron beam irradiated part.

Each end of a seamless belt formed of polyvinylidene fluoride (PVDF) was shielded with the shield member (SUS having a thickness of 10 mm) as FIG. 2 shows. The belt was irradiated with an electron beam of 80 kGy at an acceleration voltage of 150 kV in a nitrogen atmosphere while rotated at 10 m/min. The belt was rotated for 4 times to be irradiated with an electron beam of 320 kGy totally.

The belt was installed in IPSIO C310 from Ricoh Company, Ltd. as an intermediate transfer belt, and 90,000 images having a printed ratio of 5% at 23° C. 60% RH.

Comparative Example 4

The procedure for preparation and evaluation of the belt in Example 5 was repeated except that the shield member had a length such that the central irradiated area was 75% (172.5 mm).

Not only a toner and an external additive but also a paper powder remains at the cleaning part, and they adhere to a belt and grow thereon, resulting in filming. This causes poor cleaning and production of defective images.

However, when the electron beam irradiated part was extended to the cleaning area, these problems could be solved.

The results are shown in Table 4.

TABLE 4

| | Elasticity | | Tensile breaking Elongation | | Durability | | | |
|---|---|---|---|---|---|---|---|---|
| | Center E1 | End E2 | Center H1 | End H2 | Center width | (End crack) | Elongation creep | Filming |
| Example 5 | 1700 | 930 | 3% | 18% | 97% (223.1 mm) | Good | Good | Good |
| Comparative Example 4 | 1700 | 930 | 3% | 18% | 75% (172.5 mm) | Good | Good | Poor |

Example 6

Each end of a seamless belt formed of polyvinylidene fluoride (PVDF) was shielded with a shield member (SUS having a thickness of 10 mm) as FIG. 2 shows. The belt was irradiated with an electron beam of 80 kGy at an acceleration voltage of 150 kV in a nitrogen atmosphere while rotated at 10 m/min. The belt was rotated for 4 times to be irradiated with an electron beam of 320 kGy totally.

The seamless belt had a width of 230 mm, a circumferential length of 650 mm, a thickness of 100 μm and a surface resistivity of $1\times10^{10}$ when applied with 500 v at 23° C. 60% RH.

The elasticity was measured according to JIS-K7127.

Comparative Example 5

The whole surface of a seamless belt formed of polyvinylidene fluoride (PVDF) was irradiated with UV light by a high-pressure UV lamp from USHIO INC. at 450 W and an interval of 150 mm/10 min.

The results are shown in Table 5.

TABLE 5

| | Irradiation | Elasticity |
|---|---|---|
| Example 6 | Electron beam | Improved |
| Comparative Example 5 | UV | Not improved |

Example 7

8 parts by weight of electroconductive carbon black from Degussa A.G., a suitable amount of a dispersion resin, 0.5 parts of tetrabutylammonium hydrogen sulfate TBAHS ((C4H9)4NHSO4) from Koei Chemical Company, Ltd. as an ion electroconductive material, and 0.5 parts of triallylisocyanurate having the following formula from NIPPON KAYAKU Co., Ltd. as a crosslinker were added to 100 parts by weight of polyvinylidene fluoride to prepare a mixture.

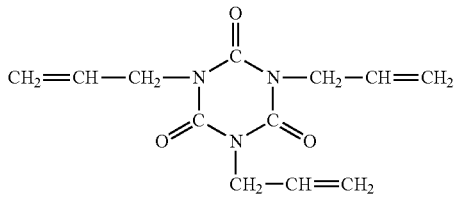

After the mixture was kneaded at 150° C. for 80 min by a kneader, the carbon black was further dispersed by a two-roll mill for 60 min and pelletized by a pelletizer to prepare an electroconductive pellet.

The pellet was extruded by an extruder to prepare a seamless belt having a thickness of 100 μm.

The results are shown in Table 6.

TABLE 6

| | Crosslinker | Elasticity |
|---|---|---|
| Example 7 | Triallylisocyanurate | 2,400 MPa |

Example 8

A strip seamless belt formed of polyvinylidene fluoride (PVDF) having a size of 15 mm×55 mm was wound around an aluminum pipe having a diameter of 20 mm, and fixed for 2 days at 50° C. 90% RH. An opening length of the belt when released was divided by 55 mm to determine a creep ratio.

The belt had a crack when wound after irradiated with an electron beam in an amount of 2,000 kGy at an acceleration voltage of 40 kV.

The belt had a creep ratio of 55% when irradiated no electron beam. There was no change of creep ratio at an acceleration voltage of 20 kV.

The results are shown in Table 7.

TABLE 7

| Example 8 | Amount of Irradiation (kGy) 10 | 100 | 1,000 | 2,000 | Acceleration Voltage (kV) |
|---|---|---|---|---|---|
| Creep ratio | 55% | 55% | 57% | 58% | 20 |
| | 60% | 66% | 67% | Cracked | 40 |
| | 60% | 67% | 67% | Cracked | 80 |
| | 62% | 68% | 68% | Cracked | 160 |
| | 63% | 70% | 70% | Cracked | 320 |
| | 65% | 71% | 71% | Cracked | 640 |

Example 9

8 parts by weight of electroconductive carbon black from Degussa A.G., 0.1 parts of an antioxidant which is tetrakis-(2,4-di-t-butylphenyl)4,4-biphenylenediphosphonite (sand) commercially named Sandostab P-EPQ (phosphorous antioxidant), 0.5 parts of tetrabutylammonium hydrogen sulfate TBAHS ((C4H9)4NHSO4) from Koei Chemical Company, Ltd. as an ion electroconductive material, a suitable amount of a dispersion resin, and further 0.5 parts of triallylisocyanurate having the following formula from NIPPON KAYAKU Co., Ltd. as a crosslinker were added to 100 parts by weight of polyvinylidene fluoride to prepare a mixture.

After the mixture was kneaded at 150° C. for 80 min by a kneader, the carbon black was further dispersed by a two-roll mill for 60 min and pelletized by a pelletizer to prepare an electroconductive pellet.

The pellet was extruded by an extruder to prepare a seamless belt having a thickness of 100 μm.

Each end of the seamless belt formed of polyvinylidene fluoride (PVDF) was shielded with a shield member (SUS having a thickness of 10 mm) as FIG. 2 shows. The belt was irradiated with an electron beam of 80 kGy at an acceleration voltage of 150 kV in a nitrogen atmosphere while rotated at 10 m/min. The belt was rotated for 4 times to be irradiated with an electron beam of 320 kGy totally.

After irradiated with an electron beam, the belt excluding an antioxidant had an abnormal odor.

The results are shown in Table 8

TABLE 8

| | Phosphorous antioxidant | Abnormal odor |
|---|---|---|
| Example 9 | 0.1 parts by weight | None |
| | None | Yes |

The belt-shaped member of the present invention having a large breaking elongation at the end can rotate without being cracked even when the end has distortion.

When the belt has a high-elasticity part not less than 50%, the belt is not elongated much even when extended with tension and the creep is prevented. Therefore, quality images are produced without color shift.

When the belt has a high-elasticity part in an image area, the belt is not plastically deformed when a toner image is pressed and quality images are produced.

When the belt has a high-elasticity part even in a cleaning area, filming with a toner, an external additive or a paper power does not occur and quality images are produced.

A belt having a high-elasticity part formed by electron beam irradiation is efficiently produced.

A belt including a crosslinker has higher elasticity when irradiated with an electron beam, and color shift and filming due to creep and elongation are prevented.

Creep ratio improves more when an amount of irradiation of electron beam is 1,000 kGy or less at an acceleration voltage not less than 40 kV.

An antioxidant prevents production of a carboxylic acid compound to prevent abnormal odor due to electron beam irradiation.

Having now fully described the invention, it will be apparent to one of ordinary skill in the art that many changes and modifications can be made thereto without departing from the spirit and scope of the invention as set forth therein.

What is claimed is:

1. A belt-shaped member, comprising:

a polyvinylidene fluoride resin, wherein the belt-shaped member has a higher crosslink density at a center than at an end;

the belt-shaped member satisfies:

$$E1 \geq E2; \text{ and}$$

$$H2 > H1;$$

E1 is an elastic modulus of the center of the belt-shaped member in a width direction perpendicular to a direction of travel of the belt-shaped member;

E2 is an elastic modulus of the end of the belt-shaped member in the width direction perpendicular to a direction of travel of the belt-shaped member;

H1 is a breaking elongation of the center; and

H2 is a breaking elongation of the end.

2. The belt-shaped member of claim 1, wherein the center has a width not less than 50% of a length of the belt-shaped member in the width direction perpendicular to a direction of travel of the belt-shaped member.

3. The belt-shaped member of claim 1, which is obtained by a process comprising irradiating with an electron beam.

4. The belt-shaped member of claim 3, wherein the electron beam has an acceleration voltage not less than 40 kV and an absorbed dose not greater than 1,000 kGy.

5. The belt-shaped member of claim 1, comprising an electron beam crosslinker.

6. The belt-shaped member of claim 1, further comprising an antioxidant.

7. An image forming apparatus, comprising the belt-shaped member according to claim 1.

8. The image forming apparatus of claim 7, wherein the center has a width not less than a width of an area in a direction of travel of the belt-shaped member that is suitable for transferring a toner image.

9. The image forming apparatus of claim 7, further comprising an element suitable for contacting a cleaner with the belt-shaped member, wherein the center has a width not less than a width of an area suitable for contacting a cleaner.

10. The belt-shaped member of claim 1, wherein the belt-shaped member is suitable for an image forming apparatus.

11. The belt-shaped member of claim 1, obtained by a process comprising crosslinking polyvinylidene fluoride with an electron beam.

12. A belt-shaped member, comprising, as a crosslinker, an isocyanurate, wherein the belt-shaped member satisfies:

$$E1 \geq E2; \text{ and}$$

$$H2 > H1;$$

E1 is an elastic modulus of a center of the belt-shaped member in a width direction perpendicular to a direction of travel of the belt-shaped member;

E2 is an elastic modulus of an end of the belt-shaped member in the width direction perpendicular to a direction of travel of the belt-shaped member;

H1 is a breaking elongation of the center; and

H2 is a breaking elongation of the end.

13. A belt-shaped member comprising, as a crosslinker, a diallylmonoglycidylisocyanurate, wherein the belt-shaped member satisfies:

$$E1 \geq E2; \text{ and}$$

$$H2 > H1;$$

E1 is an elastic modulus of a center of the belt-shaped member in a width direction perpendicular to a direction of travel of the belt-shaped member;

E2 is an elastic modulus of an end of the belt-shaped member in the width direction perpendicular to a direction of travel of the belt-shaped member;

H1 is a breaking elongation of the center; and

H2 is a breaking elongation of the end.

* * * * *